US006644277B2

(12) United States Patent
Blass et al.

(10) Patent No.: US 6,644,277 B2
(45) Date of Patent: Nov. 11, 2003

(54) HIGH PRESSURE PUMP AND ENGINE SYSTEM USING THE SAME

(75) Inventors: James R. Blass, Bloomington, IL (US); Dennis H. Gibson, Chillicothe, IL (US); George M. Matta, Washington, IL (US); Mark F. Sommars, Sparland, IL (US); Jerry A. Wear, East Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 113 days.

(21) Appl. No.: 09/958,651

(22) PCT Filed: Feb. 20, 2001

(86) PCT No.: PCT/US01/05413

§ 371 (c)(1),
(2), (4) Date: Oct. 10, 2001

(87) PCT Pub. No.: WO01/61193

PCT Pub. Date: Aug. 23, 2001

(65) Prior Publication Data

US 2002/0152991 A1 Oct. 24, 2002

Related U.S. Application Data

(60) Provisional application No. 60/183,375, filed on Feb. 18, 2000.

(51) Int. Cl.[7] ..... F02M 7/00; F02M 41/00

(52) U.S. Cl. ..... 123/446; 123/458

(58) Field of Search ..... 123/446, 458, 123/500, 501, 502, 496; 417/283, 284, 270, 298, 505

(56) References Cited

U.S. PATENT DOCUMENTS

| | | | | |
|---|---|---|---|---|
| 2,982,216 | A | | 5/1961 | Huber |
| 3,768,928 | A | * | 10/1973 | Miller et al. ..... 417/213 |
| 4,480,619 | A | | 11/1984 | Igashira et al. |
| 4,593,668 | A | | 6/1986 | Yuzawa |
| 5,022,310 | A | | 6/1991 | Stewart et al. |
| 5,603,609 | A | | 2/1997 | Kadlicko |
| 6,035,828 | A | | 3/2000 | Anderson et al. |
| 6,067,962 | A | | 5/2000 | Bartley et al. |
| 6,142,120 | A | | 11/2000 | Biester et al. |
| 6,216,670 | B1 | * | 4/2001 | Anderson et al. ..... 123/446 |
| 6,267,561 | B1 | * | 7/2001 | Sommars ..... 417/222.1 |

* cited by examiner

*Primary Examiner*—Mahmoud Gimie
(74) *Attorney, Agent, or Firm*—Alan J Hickman

(57) ABSTRACT

A high pressure pump system (14) for use with a hydraulic engine system (10), such as a fuel injection system (10) or a compression release brake system, provides variable delivery of pressurized fluid using sleeve metering principles. The relative position of metering sleeves (56) with respect to pumping pistons (32) is controlled electro-hydraulically by a control circuit (60, 160). The control circuit (60, 160) receives pressurized fluid from the pump delivery gallery (50) or another high pressure area (50, 52) and, using a pressure reducer (64, 164), reduces the operating pressure within the control circuit (60, 160) to a substantially constant pressure lower than the pump output pressure. Lower operating pressure within the control circuit (60, 160) improves the manufacturability of the control circuit components and helps to achieve better control of the pump output.

15 Claims, 10 Drawing Sheets

HIGH PRESSURE PUMP AND ENGINE SYSTEM USING THE SAME

This application is 371 of PCT/US01/05413 Feb. 20, 2001 which claims benefit of No. 60/183,375 Feb. 18, 2000.

TECHNICAL FIELD

This invention relates to a variable delivery fluid pump and an electro-hydraulic control circuit therefor, and more particularly, to a fluid pump for use with a fuel injection system or other hydraulic system for an internal combustion engine.

BACKGROUND

In a common rail fuel injection system, high pressure fluid is supplied to the injectors from a high pressure fluid accumulator or manifold, which is referred to as a rail. To permit variation of the fluid pressure supplied to injectors from the rail, it is desirable to vary the delivery of fluid to the rail from one or more fluid supply pumps. Known common rail systems typically rely on either a single fluid pump that supplies fluid to the rail or a plurality of smaller displacement pumps that each supplies fluid to the rail. The volume and rate of fluid delivery to the rail has been varied in the past by providing a rail pressure control valve that spills a portion of the delivery from a fixed delivery pump to maintain the desired rail pressure. Both high pressure and low pressure common rail systems are known in the art. In high pressure common rail systems, high pressure fuel is supplied from the rail to electrically-controlled injection nozzles. In a low pressure common rail, an actuation fluid such as fuel or engine lube oil is supplied from the rail to unit injectors, whereby the actuation fluid is used to drive a fuel pressurization plunger that pressurizes the fuel to injection pressure prior to or during each injection event.

Variable delivery pumps are well known in the art and are typically more efficient for common rail fuel systems than a fixed delivery actuation fluid pump, since only the volume of fluid need to attain the desired rail pressure must be pressurized. For example, variable delivery has been achieved from an axial piston pump, e.g. a pump wherein one or more pistons are reciprocated by rotation of an angled swash plate, by varying the angle of the swash plate and thus varying the displacement of the pump. In such a pump, the swash plate is referred to as a "wobble plate". Variable delivery has also been achieved in fixed displacement, axial piston pumps by a technique known as sleeve metering, in which each piston is provided with a vent port that is selectively closed by a sleeve during part of the piston stroke to vary the effective pumping portion of the piston stroke. An example of such a sleeve-metering pump is illustrated in commonly-owned U.S. Pat. No. 6,035,828.

While known variable delivery pumps are suitable for many purposes, known design are not always well suited for use with modem common rail fuel systems, which require fluid delivery to the rail to be varied with high precision and with rapid response times measured in microseconds. In addition, known variable delivery pumps are typically complex, may be costly, and are subject to mechanical failure. Moreover, in some known pumps such as the pump shown in commonly-owned U.S. Pat. No. 6,035,828, the relative positioning of the pumping pistons and the metering sleeves is controlled by way of an electro-hydraulic control circuit which receives high pressure fluid directly from the delivery gallery of the pump at high pressure and selectively spills that control fluid via an electrically-operable control valve. While pumps such as the one illustrated in U.S. Pat. No. 6,035,828, have performed well, room for improvement exists due the current need for small, high-precision passages and valve elements in the prior art as a result of the high fluid pressures present in the control circuit.

This invention is directed toward overcoming one or more of the problems described above.

SUMMARY OF THE INVENTION

In one aspect of this invention, a hydraulic pump system comprises a variable delivery, sleeve-metered pump having a plurality of pumping pistons and associated metering sleeves. The pumping pistons deliver pressurized fluid to a high pressure area at a pressure at least equal to a first pressure. An electrically-operated, hydraulic control circuit is operable to control the delivery of pressurized fluid from said pump by controlling the relative position between the pistons and their associated metering sleeves. The control circuit is in fluid communication with the high pressure area and has a pressure reducer to reduce pressure of fluid entering the control circuit to a control circuit pressure less than the first pressure.

In another aspect of this invention, the control circuit comprises a pressure reducing valve having an inlet in fluid communication with a high pressure area of the pump and having a valve outlet. The pressure reducing valve reduces the pressure of control fluid entering the control circuit to a predetermined control circuit pressure. A movable control member has a first control surface and a second control surface opposed with the first control surface, movement of the control member changing the relative positioning between the pumping pistons and their associated sleeves. A control line is in fluid communication with the pressure reducing valve outlet and has a first, relatively unrestricted passageway through which fluid pressure is applied to the first control surface and a second, relatively-restricted passageway through which fluid pressure is applied to the second control surface. An electrically operated control valve is fluidly connected with the control line to selectively control the relative fluid pressures applied to the first and second control surfaces.

In yet another aspect of this invention, the control circuit comprises a pressure reducing valve having an inlet in fluid communication with a high pressure area of the pump and having a valve outlet. The pressure reducing valve reduces the pressure of control fluid entering the valve to a predetermined control circuit pressure. A movable control member has a control surface, and movement of the control member changes the relative positioning between the pumping pistons and their associated sleeves. A control line is in fluid communication with the pressure reducing valve outlet and has a restricted passageway through which fluid pressure is applied to the control surface. A bias member applies force to the control member in a direction opposite the fluid pressure applied to the control surface. An electrically operated control valve is fluidly connected with the control line to selectively control the fluid pressure applied to the control surface.

In still another aspect of this invention, a method of controlling the delivery of pressurized fluid from a variable delivery, sleeve-metered pump is provided. The pump comprises a plurality of pumping piston and associated metering sleeves. The method comprising reciprocating the pistons to thereby deliver pressurized fluid to a high pressure area of the pump at pressure at least equal to a first pressure, delivering a portion of the pressurized fluid to a control circuit operable to selectively control the relative position between the pistons and their associated metering sleeves, reducing the pressure of the fluid delivered to the control circuit to a pressure less than the first pressure, and using the reduced-pressure fluid to control the relative position between the pistons and their associated metering sleeves, thereby controlling the delivery of pressurized fluid from the pump.

DETAILED DESCRIPTION

Figure 1:
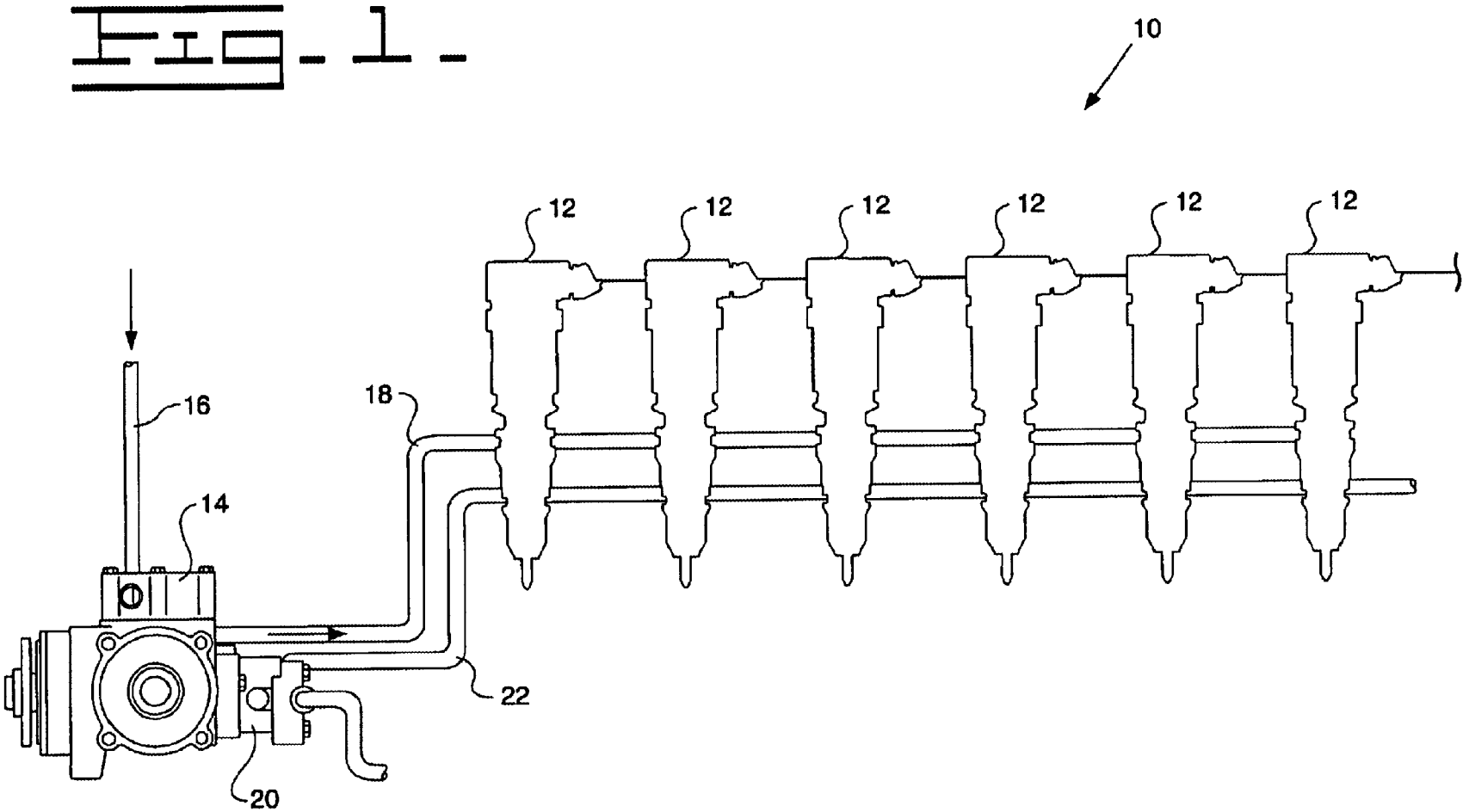
FIG. 1 is a diagrammatic representation of a low pressure common rail fuel injection system in accordance with this invention.
Figure 2:
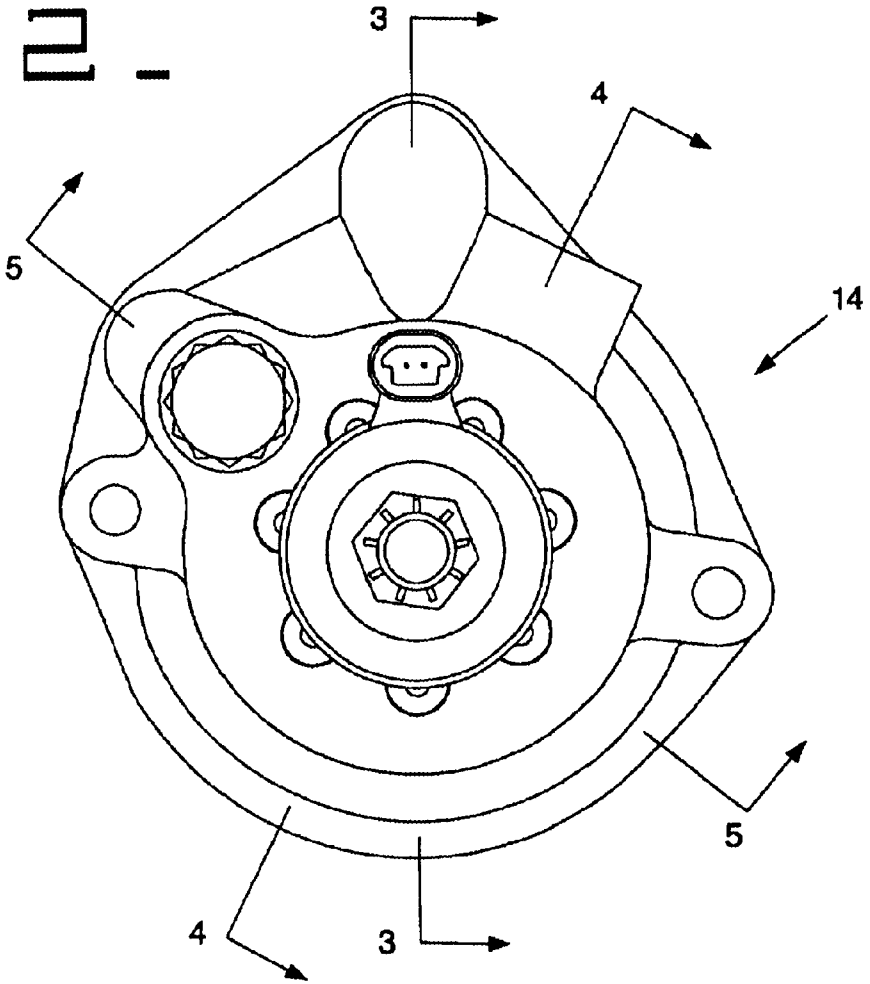
FIG. 2 is an end elevation of a pump in accordance with this invention used in the fuel injection system shown in FIG. 1.
Figure 3:
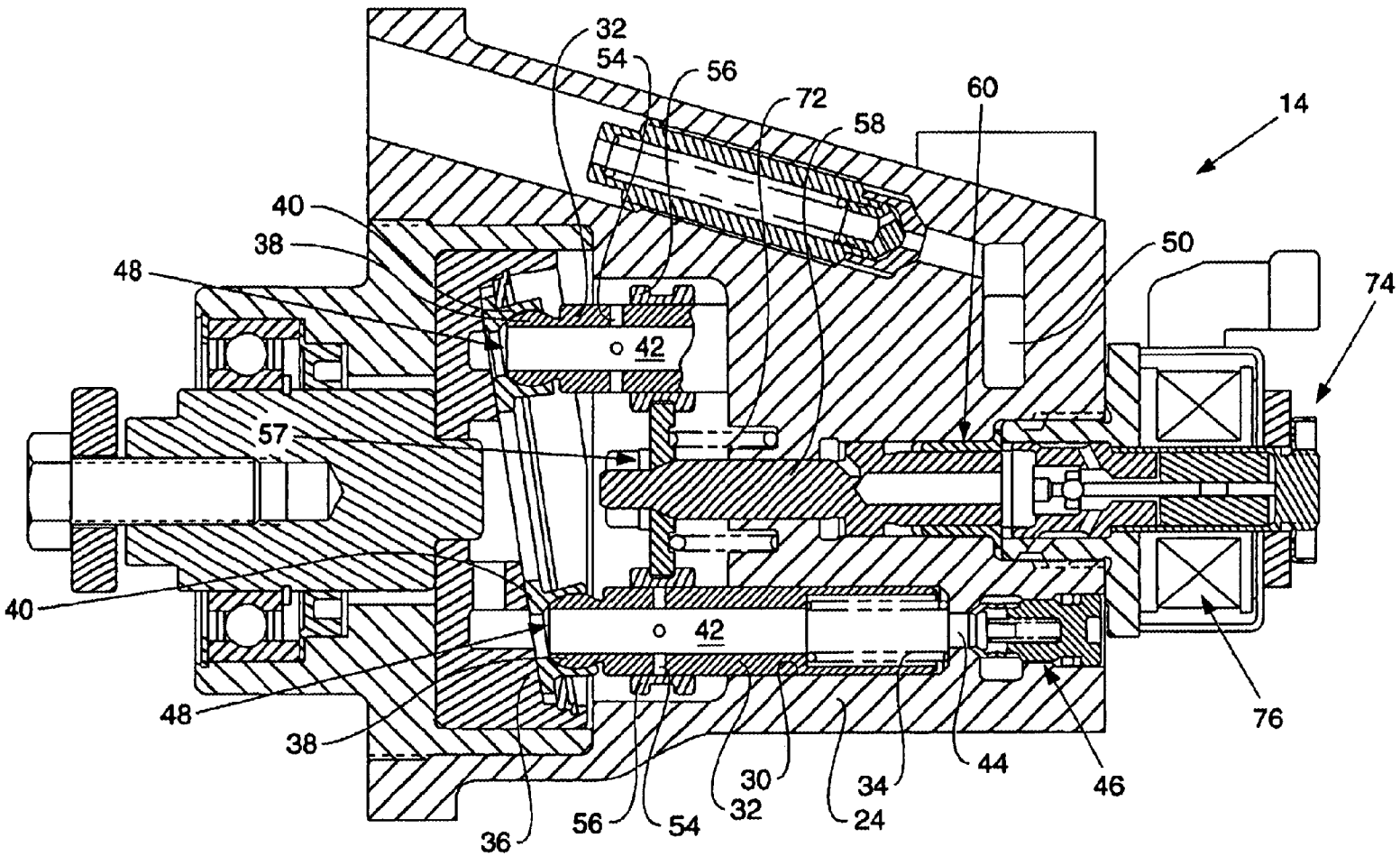
FIGS. 3 through 5 are cross sections of the pump shown in FIG. 2 taken along lines 3—3, 4—4, and 5—5 thereof, respectively.
Figure 4:
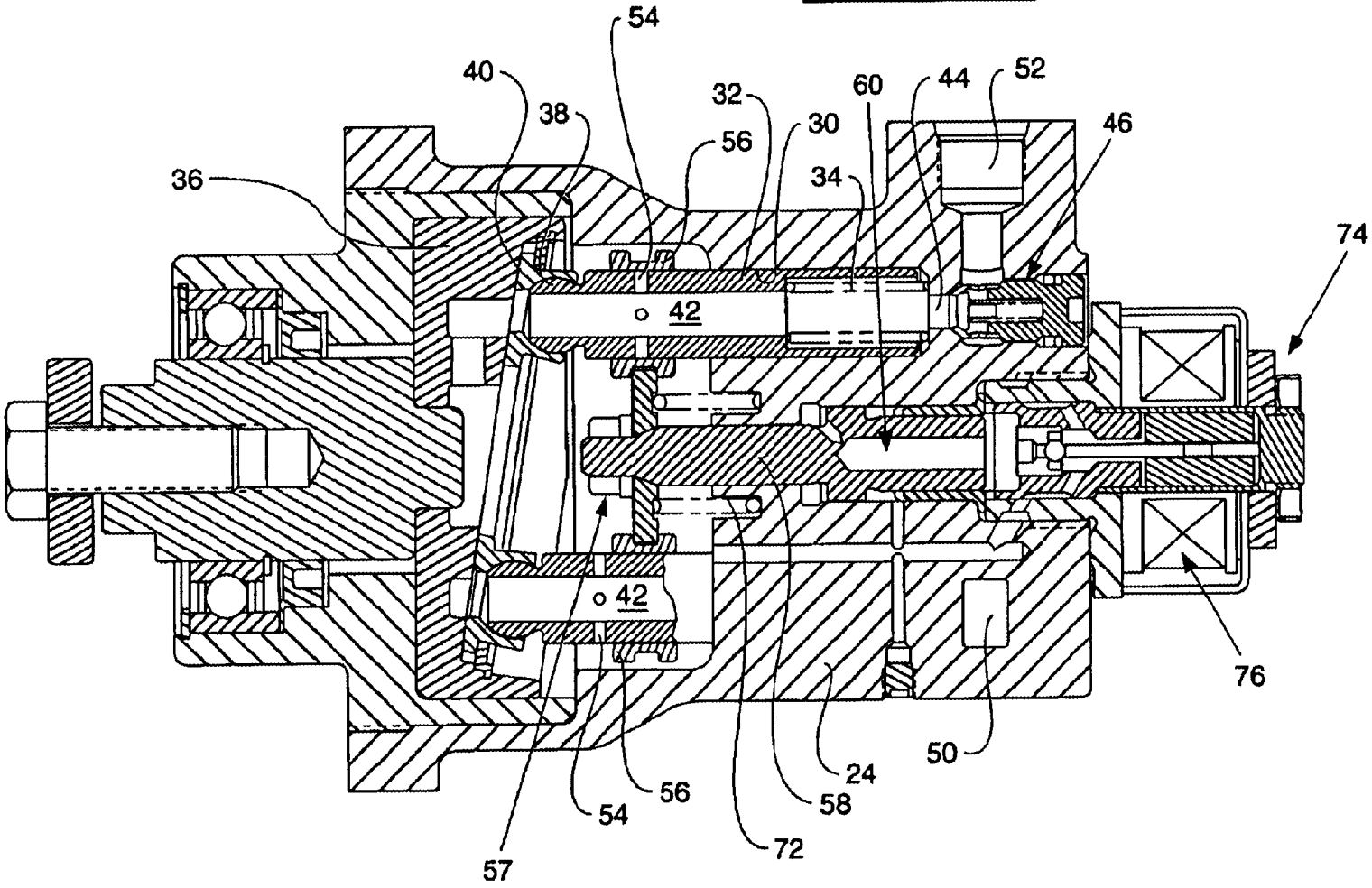
Figure 5:
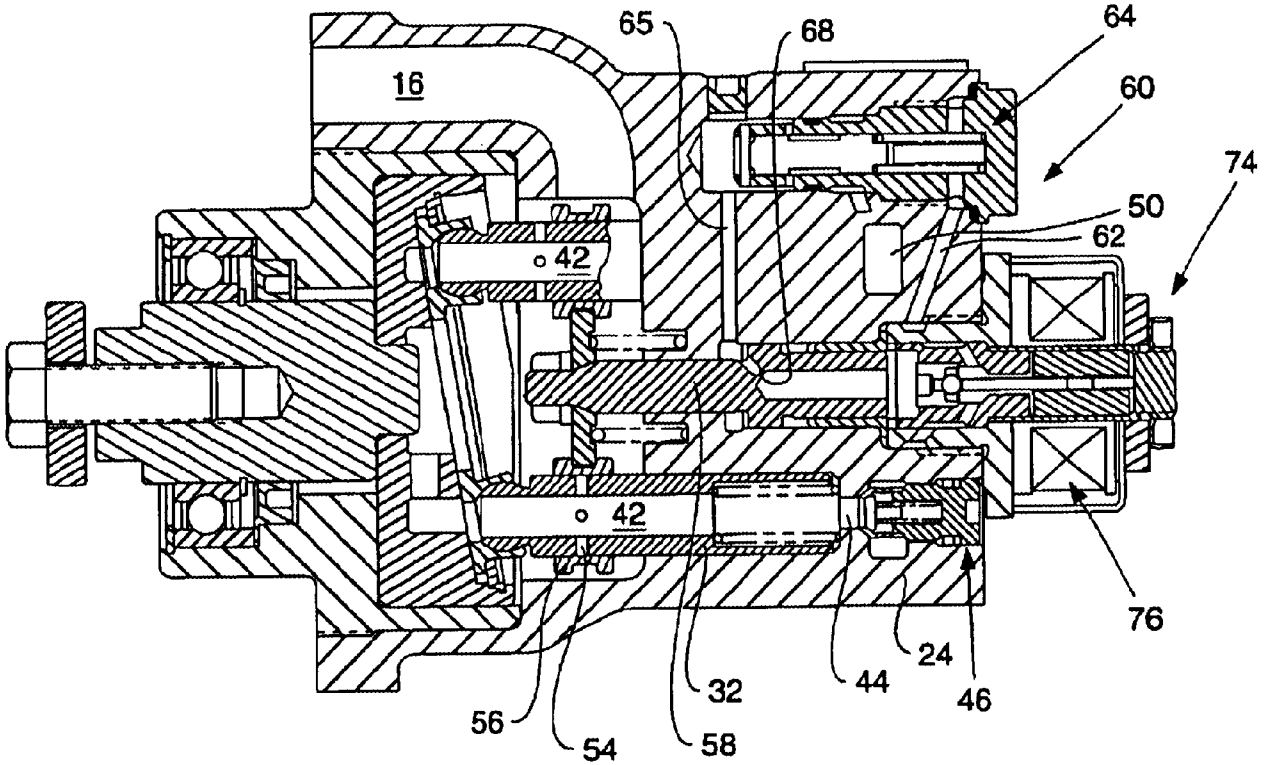
Figure 6:
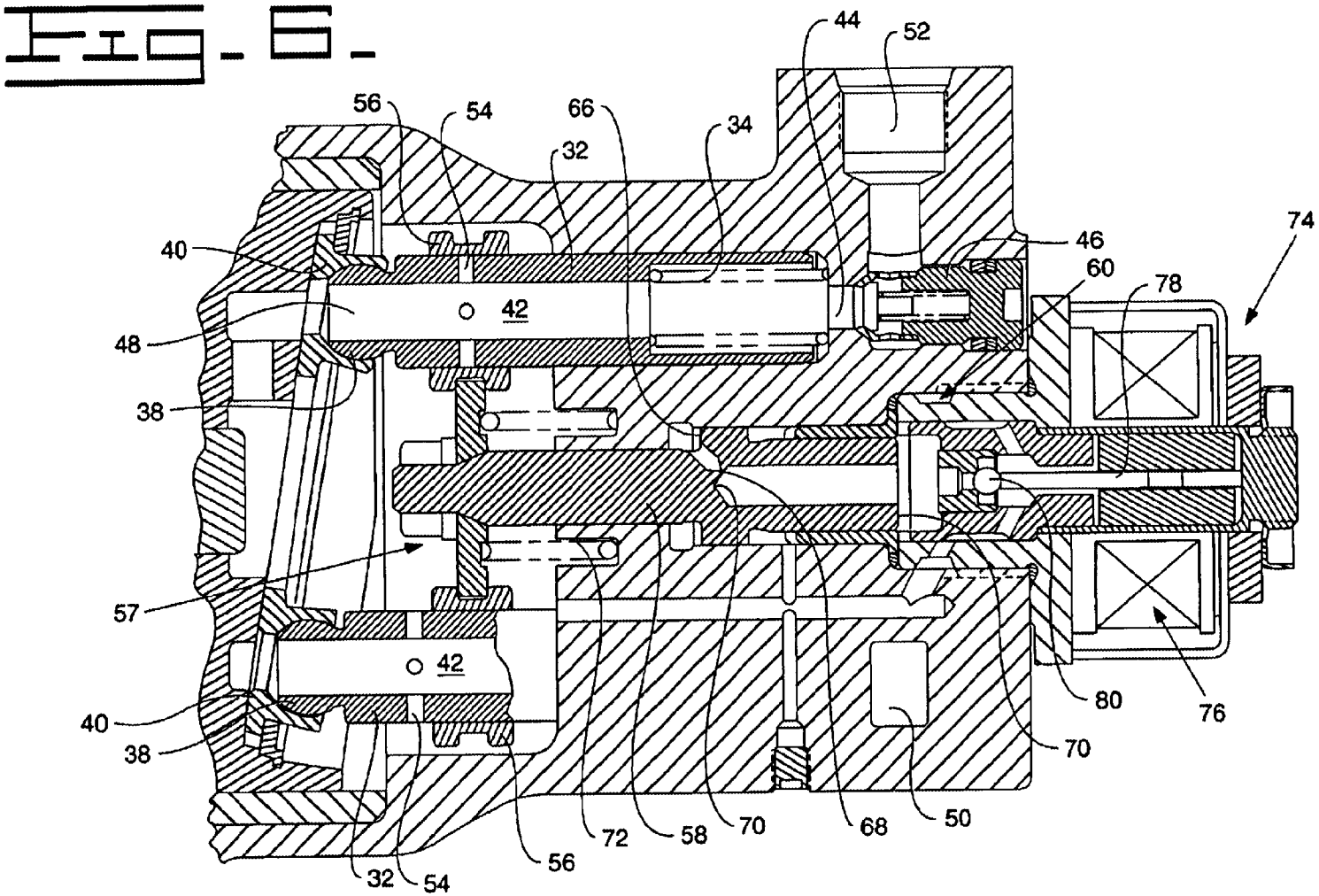
FIGS. 6 and 7 are enlarged views of portions of FIGS. 4 and 5, respectively.
Figure 7:
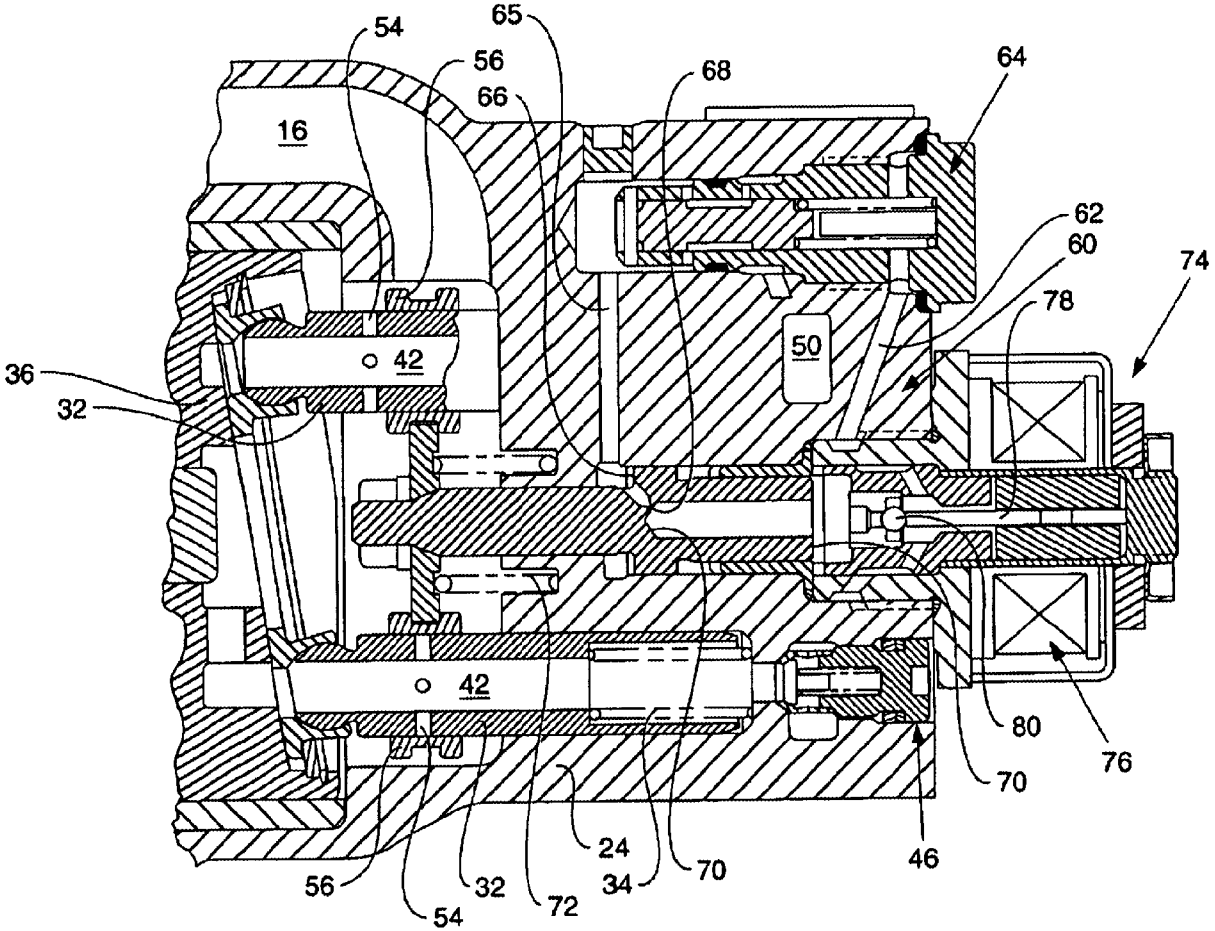

FIG. 1 diagrammatically illustrates a fluid actuated diesel fuel injection system 10 with which this invention may be used. In particular, the fuel injection system includes a plurality of fluid-actuated injectors 12, which may be unit injectors as illustrated or unit pumps injectors (not shown), powered via a variable delivery, fixed displacement fluid pump 14 in accordance with this invention. Actuation fluid is supplied to the pump 14 via an inlet 16. High-pressure actuation fluid is supplied from the pump 14 to the unit pump injectors 12 via a manifold or common rail 18. A conventional fuel transfer pump 20 supplies fuel to the injectors 12 via a common fuel rail 22. The fuel system 10 illustrated in FIG. 1 preferably includes HEUI™ fuel injector available from Caterpillar Inc, preferably having a nozzle check valve operable independent of injection pressure, such as the injectors described in commonly-owned U.S. Pat. Nos. 5,463,996, 5,669,335, 5,673,669, 5,687,693, 5,697,342, and 5,738,075.

Of course, one skilled in the art will recognize that the injectors 12 may be hydraulically actuated fuel injectors having other configurations, such as those illustrated in patents granted to Sturman Industries and/or Oded E. Sturman (for example, U.S. Pat. No. 5,460,329) or otherwise using one or more high speed spool valves. Similarly, the pump 14 according to this invention may be used with conventional high pressure common rail systems or with the amplifier piston common rail system (APCRS) illustrated in the paper "Heavy Duty Diesel Engines—The Potential of Injection Rate Shaping for Optimizing Emissions and Fuel Consumption", presented by Messrs. Bemd Mahr, Manfred Dürnholz, Wilhelm Polach, and Hermann Grieshaber; Robert Bosch GmbH, Stuttgart, Germany, at the 21$^{st}$ International Engine Symposium, May 4–5, 2000, Vienna, Austria. The pump 14 in accordance with this invention may also be suitable for use with fuels other than diesel fuel, such gasoline for example in a gasoline direction injection (GDI) application With reference to FIGS. 2 through 7, the actuation fluid pump 14 is generally an axial, swash plate-type piston pump. The pump comprises an integral housing and barrel 24 that defines a plurality of cylinders 30 therein. Each cylinder 30 has slidably received therein a portion of a piston 32, and a spring 34 is trapped between each piston 32 and the base of its corresponding cylinder 30. Each piston 32 is connected at one end by a spherical mounting arrangement to a fixed angle swash plate 36. More particularly, each piston 32 includes a spherical head 38 received within socket in a shoe 40 slidably mounted to the swash plate 36 by a hydrostatic bearing. As the swash plate 36 rotates, the pistons 32 are caused to move through a reciprocal stroke within the cylinders 30.

The cylinders 30 and the pistons 32 cooperate to define a plurality of variable volume fluid compression chambers 42. Each fluid compression chamber 42 has a delivery outlet 44 that is closed during the intake stroke by a conventional, but preferably cartridge-type, spring-biased check valve 46. Each fluid compression chamber 42 also has a fluid inlet 48 to allow fluid to be drawn into the chamber 42 during the intake stroke. The fluid inlet 48 is preferably an inlet slot in the swash plate 36 that opens to ports in the heads 38 of the pistons 32. The delivery outlets 44 each open to a common delivery gallery 50 in fluid communication with the outlet 52 of the pump.

Each fluid compression chamber 42 has a vent port 54 opening therefrom. As apparent, the vent ports 54 are operable to vent fluid from the fluid compression chambers 42 during a portion of the reciprocal stroke of the piston 32. Each piston 32 has associated therewith a concentric sleeve 56 that is positioned to close the vent port 54 therein during portion of the piston stroke. The relative position of the sleeves 56 determines the effective pumping stokes of the pistons 32 and thus the output pressure of the pump. To provide a compact structure, the sleeves 56 are connected via a linkage 57 with a control shaft or member 58 located centrally between the pistons 32 and extending parallel to their axes of reciprocation.

Figure 8:
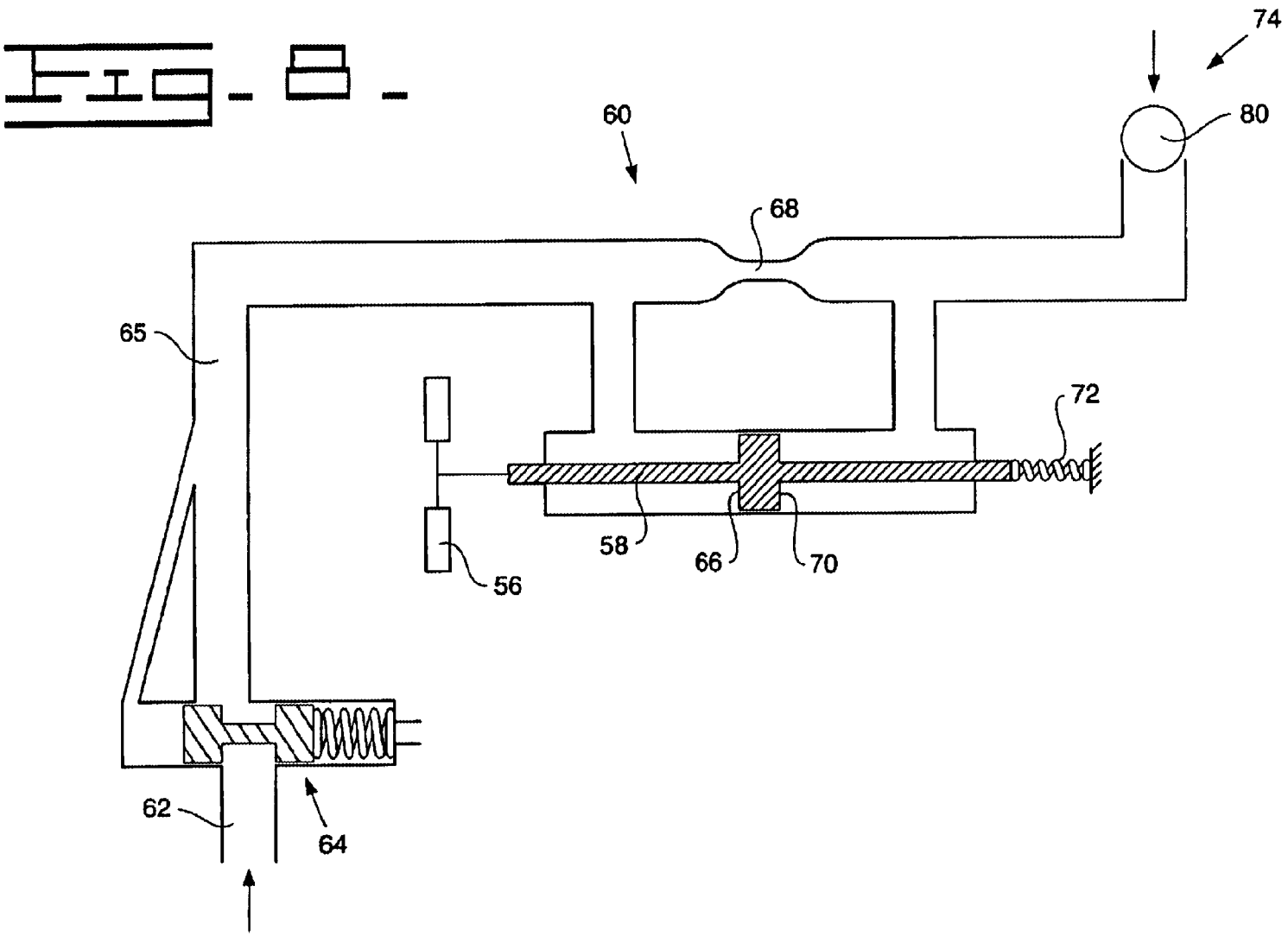
FIG. 8 is a diagrammatic illustration of a control circuit according to one embodiment of this invention.

The pump 14 also include a pilot control stage or control circuit, generally designated 60, that is used to control axial movement of the control shaft 58 and thus control the position of the sleeves 56. FIG. 8 illustrates diagrammatically the control circuit 60 shown in FIGS. 2 through 7.

Figure 10:
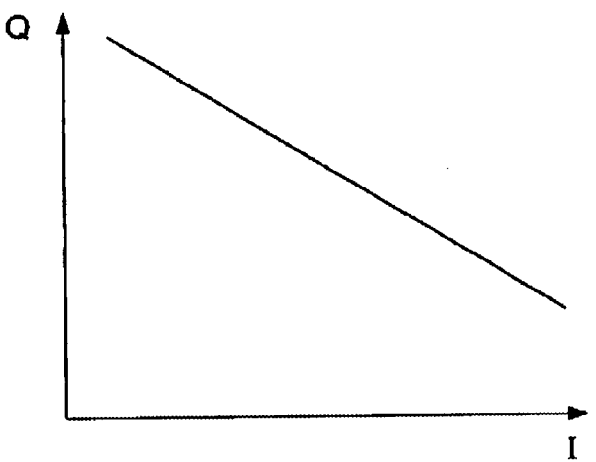
FIG. 10 is a graph illustrating the relationship between control current I and pump output Q for a pump using the control circuit shown in FIG. 8.

With reference to FIGS. 2 through 8, high pressure oil from the pump delivery gallery 50 (or alternatively the pump outlet 52 or another high pressure area) is directed through a hydraulic passage 62 that leads to a conventional spool-type or other suitable pressure reducing valve, generally designated 64, which is well known in the art and not described in detail herein. The valve 64 reduces the oil pressure in the control circuit 60 to a predetermined control circuit pressure significantly less than the maximum pump outlet pressure. For example, for pumps having a maximum outlet pressure on the order of 28–30 MPa, it is desirable to reduce the pressure in the control circuit 60 to around 4 MPa. The reduced pressure oil from the reducing valve 64 flows through a relatively-unrestricted passageway 65 and acts on a first control surface 66 forming part of or connected to the control shaft 58. The oil also passes through a relatively-restricted passageway or control orifice 68 that creates a pressure differential whereby lower pressure oil acts on a second control surface 70 that is opposed to the first control surface 66. The pressure differential between the first and second control surfaces 66, 70 creates a force imbalance that moves the control shaft 58 to the right. A spring 72 provides a force to move the control shaft 58 to the left. The direction of motion of the control shaft 58 is determined by the larger of the resultant fluid pressure force or the spring force. The control circuit 60 includes a control valve, generally designated at 74, that is used to change the amount of oil that flows through the control orifice 68. The control valve 74 comprises a solenoid or piezo actuator 76 that moves a pin 78 that is in contact with a conventional ball valve 80. Of course, a poppet or spool valve could also be used. By varying the current to the valve actuator, the position of the ball valve 80 is varied, thus varying the amount of oil that is allowed to flow around the ball valve 80. As the amount of oil flowing through the control valve 74 changes, the force imbalance on the control shaft 58 changes to control the motion of the control shaft 58. In short, the specific current applied to the solenoid or piezo actuator 76 determines the amount of oil that flows through the control orifice 68, which in turn determines the force differential on the control shaft 58, which in turn determines the effective displacement of pistons 32, which in turn determines the pump output. FIG. 10 illustrates, diagrammatically, the relationship between the current I that is applied to the control valve 74 and the output Q of the pump.

Figure 9:
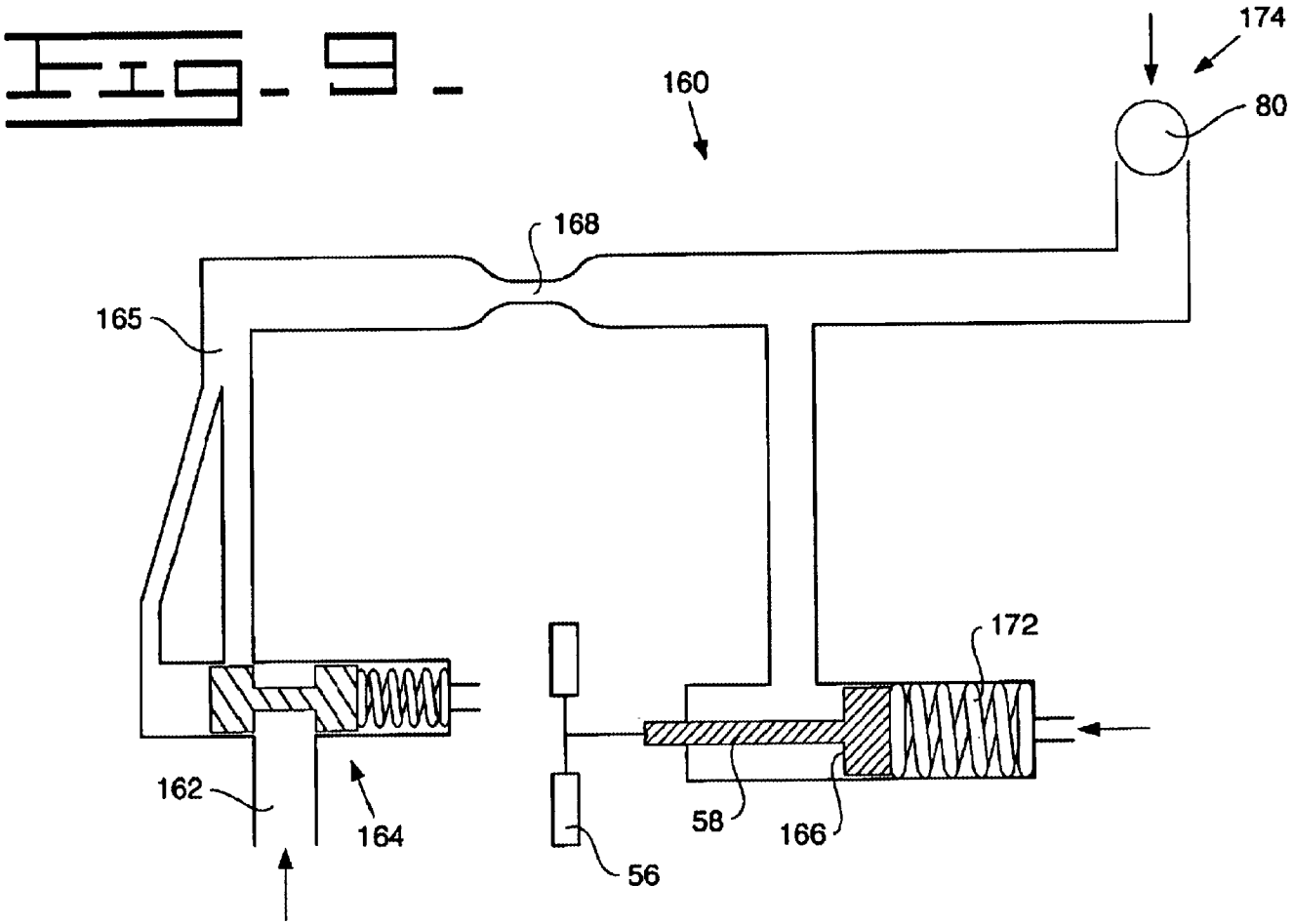
FIG. 9 is a diagrammatic illustration of a control circuit according to a second embodiment of this invention.
Figure 11:
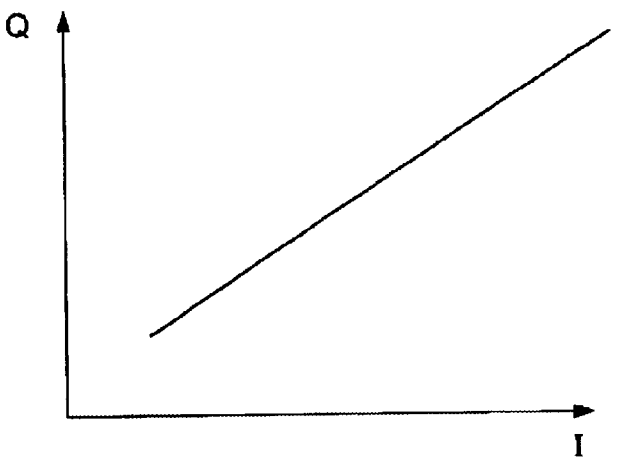
FIG. 11 is a graph illustrating the relationship between control current I and pump output Q for a pump using the control circuit shown in FIG. 9.

With reference now to FIGS. 9 and 11, an alternative embodiment 160 of a control circuit is shown diagrammatically. High pressure oil from the pump delivery gallery 50 is directed through a hydraulic passage 162 that leads to a conventional spool-type or other suitable pressure reducing valve, generally designated 164. The valve 164 reduces the oil pressure in the control circuit 160 to a predetermined control circuit pressure significantly less than the maximum pump outlet pressure. The reduced-pressure oil also passes from a control line 165 through a relatively-restricted passageway or control orifice 168 that acts to reduce the fluid pressure from the predetermined pressure set by the reducing valve 164. The oil then acts on a control surface 166 on the control shaft 58. A force from spring 172 is applied opposite to the fluid force applied to control surface 166. The force differential between the force applied to the control surface 166 and the spring force creates a force imbalance that moves the control shaft 58. The direction of motion of the control shaft 58 is determined by the larger of the fluid pressure force applied to control surface 166 or the spring force. The control circuit 60 includes a control valve, generally designated 174, that is used to change the amount of oil that flows through the control orifice 168. By varying the current to the valve actuator, the amount of oil that is allowed to flow through the control valve 174 changes. As the amount of oil flowing through the control valve 174 changes, the force imbalance on the control shaft 58 changes to control the motion of the control shaft 58. FIG. 11 illustrates, diagrammatically, the relationship between the current I that is applied to the control valve 174 and the output Q of the pump.

INDUSTRIAL APPLICABILITY

Prior pump designs of similar sleeve-metering configuration use full pump pressure to move the control shaft, and as a consequence, require a very small ball valve to allow only a small flow through the control valve.

Because the present designs relies on a reduced pressure, a larger ball valve can be used, which eases manufacture and improves pump control. Moreover, the pump can be operated using displacement control, for which there is a single pump output associated with each current level applied to the solenoid or piezo actuator. Thus, if a rail pressure change is needed, the current corresponding to the desired pressure is sent to the solenoid or piezo actuator to directly set the rail pressure that corresponds to the displacement set by the applied current. This is compared to prior designs, which are not admitted to be prior art, that utilize pressure control by sensing pressure in the rail and adjusting the sleeve position until the desired pressure is sensed in the rail. The pump configuration according to this invention also provides a compact and efficient package, in part as a result of the central positioning of the control shaft 58 and the end attachment of the control valve 60.

This invention is illustrated in the context of a sleeve-metered pump is which the metering sleeves are movable relative to the pumping piston. However, one skilled in the art will recognize that this invention is also applicable to other pump configurations, including a pump configuration such as that illustrated in commonly-owned laid-open German patent application 199 60 569.6, filed on Dec. 15, 1999, which illustrates a pump in which the relative positioning of the pumping pistons with the "metering sleeves" is controlled by moving the pump swash plate with respect to the "metering sleeves". In addition, while this invention is illustrated in connection with a fuel injection system, those skilled in the art will recognize that this invention is equally applicable to use with other hydraulic engine systems, such as engine valve actuators and/or compression release retarders.

Although the presently preferred embodiments of this invention have been described, it will be understood that within the purview of the invention various changes may be made within the scope of the following claims.

What is claimed is:

1. A hydraulic pump system, comprising:

a variable delivery, sleeve-metered pump having a plurality of pumping pistons and associated metering sleeves, said pumping pistons delivering pressurized fluid to a high pressure area at a pressure at least equal to a first pressure; and an electrically-operated, hydraulic control circuit operable to control the delivery of pressurized fluid from said pump by controlling the relative position between said pistons and their associated metering sleeves, said control circuit being in fluid communication with said high pressure area and having a pressure reducer to reduce the pressure of fluid entering said control circuit to a control circuit pressure less than said first pressure.

2. The hydraulic pump system of claim 1 wherein said control circuit pressure is substantially constant.

3. The hydraulic pump system of claim 1 wherein said pump includes a housing and wherein said control circuit is disposed within said housing.

4. A hydraulic engine system, comprising:

a variable livery sleeve-metered pump according to claim 1;

a fluid manifold having an inlet fluidly connected with the outlet of said variable delivery sleeve-metered pump; and at least one hydraulic device connected with said fluid manifold.

5. The hydraulic engine system of claim 4 wherein said at least one hydraulic device includes a fuel injector.

6. The hydraulic engine system of claim 5 wherein said fuel injector includes a unit injector.

7. The hydraulic engine system of claim 4 wherein said at least one hydraulic device includes an engine valve actuator.

8. The hydraulic engine system of claim 7 wherein said engine valve actuator includes a compression release retarder.

9. A method of controlling the delivery of pressurized fluid from a variable delivery, sleeve-metered pump, said pump having a plurality of pumping pistons and associated metering sleeves, said method comprising:

reciprocating said pistons to thereby deliver pressurized fluid to a high pressure area of said pump at a pressure at least equal to a first pressure;

delivering a portion of the pressurized fluid to a control circuit operable to selectively control the relative position between said pistons and their associated metering sleeves;

reducing the pressure of the fluid delivered to said control circuit to a pressure less than said first pressure; and using said reduced-pressure fluid to control the relative position between said pistons and their associated metering sleeves, thereby controlling the delivery of pressurized fluid from said pump.

10. A control circuit for a sleeve-metered pump, said sleeve-metered pump having a plurality of pumping pistons and associated metering sleeves, comprising:

a pressure reducing valve having an inlet in fluid communication with a high pressure area of said sleeve-metered pump and having a valve outlet, said pressure reducing valve reducing the pressure of control fluid entering said control circuit to a predetermined control circuit pressure;

a movable control member having a first control surface and a second control surface opposed with said first control surface, movement of said control member changing the relative positioning between said pumping pistons and their associated sleeves;

a control line in fluid communication with said pressure reducing valve outlet and having a first, relatively unrestricted passageway through which fluid pressure is applied to said first control surface and a second, relatively-restricted passageway through which fluid pressure is applied to said second control surface;

an electrically operated control valve fluidly connected with said control line to selectively control the relative fluid pressures applied to said first and second control surfaces.

11. The control circuit of claim 10 wherein said control circuit pressure is substantially constant.

12. The control circuit of claim 10 wherein said control member is connected via a control linkage to said metering sleeves such that movement of said control member causes said metering sleeves to move with respect to their associated pumping pistons.

13. A control circuit for a sleeve-metered pump, said sleeve-metered pump having a plurality of pumping pistons and associated metering sleeves, comprising:

a pressure reducing valve having an inlet in fluid communication with a high pressure areas of said sleeve-metered pump and having a valve outlet, said pressure reducing valve reducing the pressure of control fluid entering said valve to a predetermined control circuit pressure;

a movable control member having a control surface, movement of said control member changing the relative positioning between said pumping pistons and their associated sleeves;

a control line in fluid communication with said pressure reducing valve outlet and having a restricted passageway through which fluid pressure is applied to said control surface;

a bias member applying a force to the control member in a direction opposite the fluid pressure applied to said control surface; and an electrically operated control valve connected with said control line to selectively control the fluid pressure applied to said control surface.

14. The control circuit of claim 13 wherein said control pressure is substantially constant.

15. The control circuit of claim 13 wherein said control member is connected via a control linkage to said metering sleeves and movement of said control member causes said metering sleeves to move with respect to their associated pumping pistons.

* * * * *